US008955197B2

(12) United States Patent
Bailey

(10) Patent No.: US 8,955,197 B2
(45) Date of Patent: Feb. 17, 2015

(54) DETACHABLE GRAB HANDLE

(71) Applicant: Kelly R. Bailey, Miami Beach, FL (US)

(72) Inventor: Kelly R. Bailey, Miami Beach, FL (US)

( * ) Notice: Subject to any disclaimer, the term of this patent is extended or adjusted under 35 U.S.C. 154(b) by 7 days.

(21) Appl. No.: 13/713,037

(22) Filed: Dec. 13, 2012

(65) Prior Publication Data

US 2013/0145581 A1 Jun. 13, 2013

Related U.S. Application Data

(60) Provisional application No. 61/569,823, filed on Dec. 13, 2011.

(51) Int. Cl.

| | |
|---|---|
| ***A45C 13/22*** | (2006.01) |
| ***A45F 5/10*** | (2006.01) |
| ***A45C 13/26*** | (2006.01) |

(52) U.S. Cl.

CPC ..... *A45C 13/22* (2013.01); *A45F 5/102* (2013.01); *A45F 2005/104* (2013.01); *A45C 2013/223* (2013.01); *A45F 5/10* (2013.01); *A45C 13/26* (2013.01); *A45F 2005/1073* (2013.01)

USPC ..... 16/422; 16/406; 16/428

(58) Field of Classification Search

CPC ... A45F 5/102; A45F 2005/1073; A45F 5/10; A45F 2005/104; A45F 2005/108; A45C 13/26; A45C 13/22; A45C 2013/223

USPC ..... 16/422, 425, 426, 428, 114.1, 405, 406, 16/411; 190/115, 116, 117; 294/153

See application file for complete search history.

(56) References Cited

U.S. PATENT DOCUMENTS

| | | | | |
|---|---|---|---|---|
| 5,253,393 | A * | 10/1993 | Levin | 24/301 |
| 5,514,019 | A | 5/1996 | Smith | |
| 5,619,751 | A | 4/1997 | Ray et al. | |
| 6,290,040 | B1 * | 9/2001 | Chen | 190/39 |
| 6,554,033 | B2 * | 4/2003 | Hydon | 150/155 |
| 6,658,698 | B2 * | 12/2003 | Chen | 16/114.1 |
| 2012/0013140 | A1 * | 1/2012 | Nitkin | 294/153 |

* cited by examiner

*Primary Examiner* — Jeffrey O Brien

(74) *Attorney, Agent, or Firm* — Fraser Clemens Martin & Miller LLC; Jacob M. Ward

(57) ABSTRACT

A detachable handle includes a flexible elongate member, a pair of swivel clips, and a tubular grip. Each of the swivel clips is coupled to the flexible elongate member. The flexible elongate member is disposed through the tubular grip. The swivel clips are disposed at opposite ends of the tubular grip, and militate against a removal of the flexible elongate member from the tubular grip.

17 Claims, 5 Drawing Sheets

DETACHABLE GRAB HANDLE

CROSS-REFERENCE TO RELATED APPLICATIONS

This application claims the benefit of U.S. Provisional Application No. 61/569,823, filed on Dec. 13, 2011. The entire disclosure of the above application is hereby incorporated herein by reference.

FIELD OF THE INVENTION

The present disclosure relates to detachable handle and, more particularly, to a detachable grab handle for use with a personal floatation device.

BACKGROUND OF THE INVENTION

The use of personal watercraft is very popular. Many personal watercrafts are designed to hold more than one person. When more than one person are riding on the watercraft, a rider typically sits close behind the watercraft's operator, and wraps his or her arms around the operator's waist. Since it is mandatory that the operator wears a life jacket, for safety reasons, the rider often has difficulty maintaining a firm grasp on the operator. This is especially problematic because the rider can be seriously injured if the rider looses his or her grip and falls off the watercraft.

Handles on safety vests are known, for example, as described in U.S. Pat. No. 5,514,019 to Smith and U.S. Pat. No. 5,619751 to Ray et al. The entire disclosures of each of the aforementioned U.S. patents are hereby incorporated herein by reference. However, the known handles are generally permanently affixed to the safety vests, and thus not readily customizable for different types of vests or sizes of riders. Known handles that are detachable employ snaps that are prone to disengaging at undesirable times during operation. These handles are also not readily adaptable for uses other than safety vests.

There is a continuing need for a reliable detachable handle that may be used with a conventional personal floatation device. Desirably, the detachable handle may also be readily adapted for other uses such as the carrying of a load or package.

SUMMARY OF THE INVENTION

In concordance with the instant disclosure, a reliable detachable handle that may be used with a conventional personal floatation device, and which may also be readily adapted for other uses such as the carrying of a load or package, is surprisingly discovered.

In an illustrative embodiment, the detachable handle of the present disclosure aids a rider in remaining stably connected to an operator in front of the rider on a personal watercraft. The detachable handle can be attached to a vertical strap on a front or a back of a personal floatation device worn by the operator. The location of the detachable handle may depend on a vest style, or what is most comfortable for the rider. Advantageously, the detachable handle may be removed and can be used on various sizes of the personal floatation device, including a variety of adult sizes.

In an exemplary embodiment, the detachable handle has plastic clips on the end of two sides of a plastic or foam rubber handle, which easily clip to a front of a life jacket. The handle is meant for individuals who ride tandem on a personal watercraft. The handle is useful for the passenger to remain stable and connected to the operator or other person in front of the passenger on the personal watercraft. The handle provides an easier and more comfortable riding experience.

In one embodiment, a detachable handle includes a flexible elongate member, a pair of swivel clips, and a tubular grip. Each of the swivel clips is coupled to the flexible elongate member. The flexible elongate member is disposed through the tubular grip. The swivel clips are disposed at opposite ends of the tubular grip, and militate against a removal of the flexible elongate member therefrom.

In another embodiment, a method for manufacturing a detachable handle includes a step of providing a flexible elongate member of a durable material having a pair of free ends. One of a pair of swivel clips is disposed on the flexible elongate member. Both free ends of the flexible elongate member are then disposed through a tubular grip. Another of the pair of swivel clips is disposed over one of the free ends of the flexible elongate member, so that the swivel clips are disposed on opposite ends of the tubular grip. The free ends are then connected to create a closed loop, thereby forming the detachable handle. The swivel clips are sized appropriately to militate against a removal of the flexible elongate member from the tubular grip.

In a further embodiment, a detachable handle system includes a surface, for example, provided by one of a personal floatation device, a load, a package, and a wall, and the detachable handle. The detachable handle is removably coupled to the surface.

DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, are not necessary or critical.

Figure 2A:
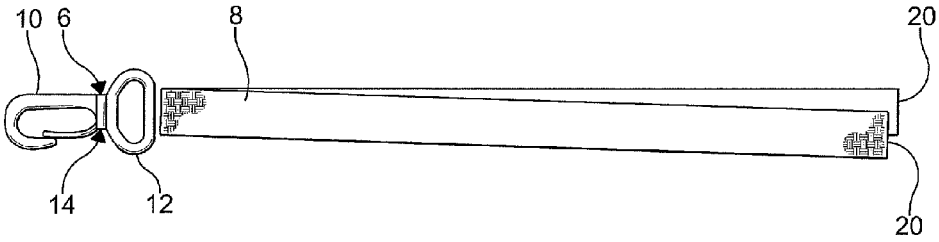
FIGS. 2A-2D illustrate a stepwise method for assembling the detachable handle shown in FIG. 1.
Figure 2B:
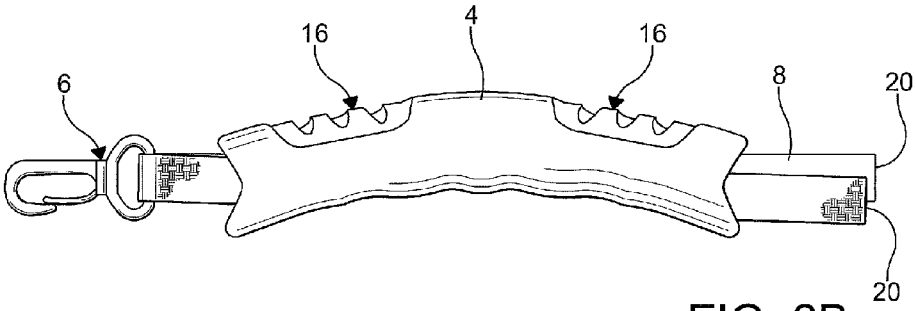
Figure 2C:
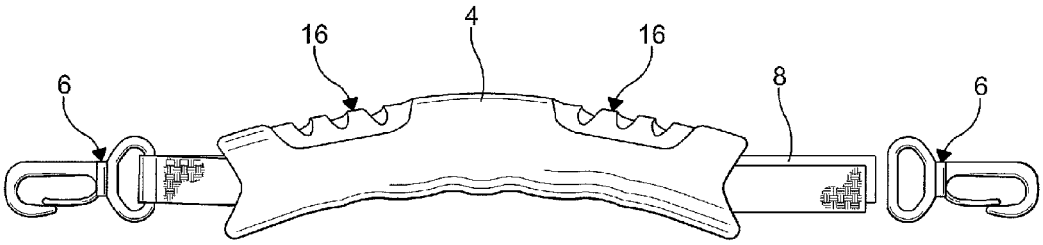
Figure 2D:
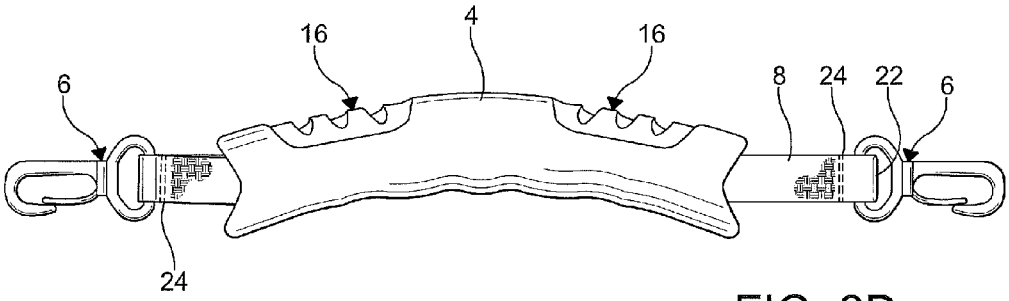
Figure 3:
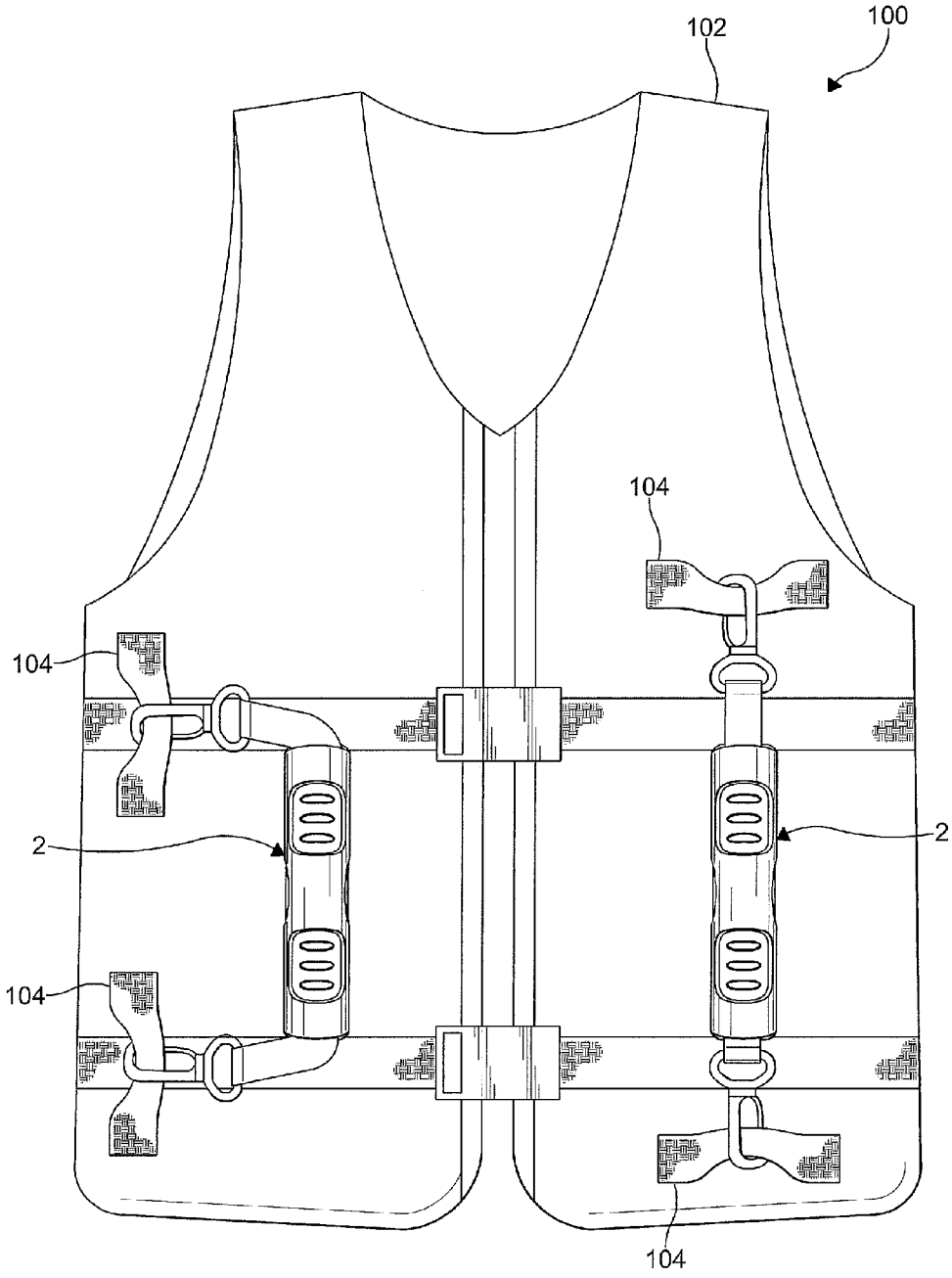
FIG. 3 is front elevational view of a personal floatation device having the detachable handle shown in FIG. 1.
Figure 4:
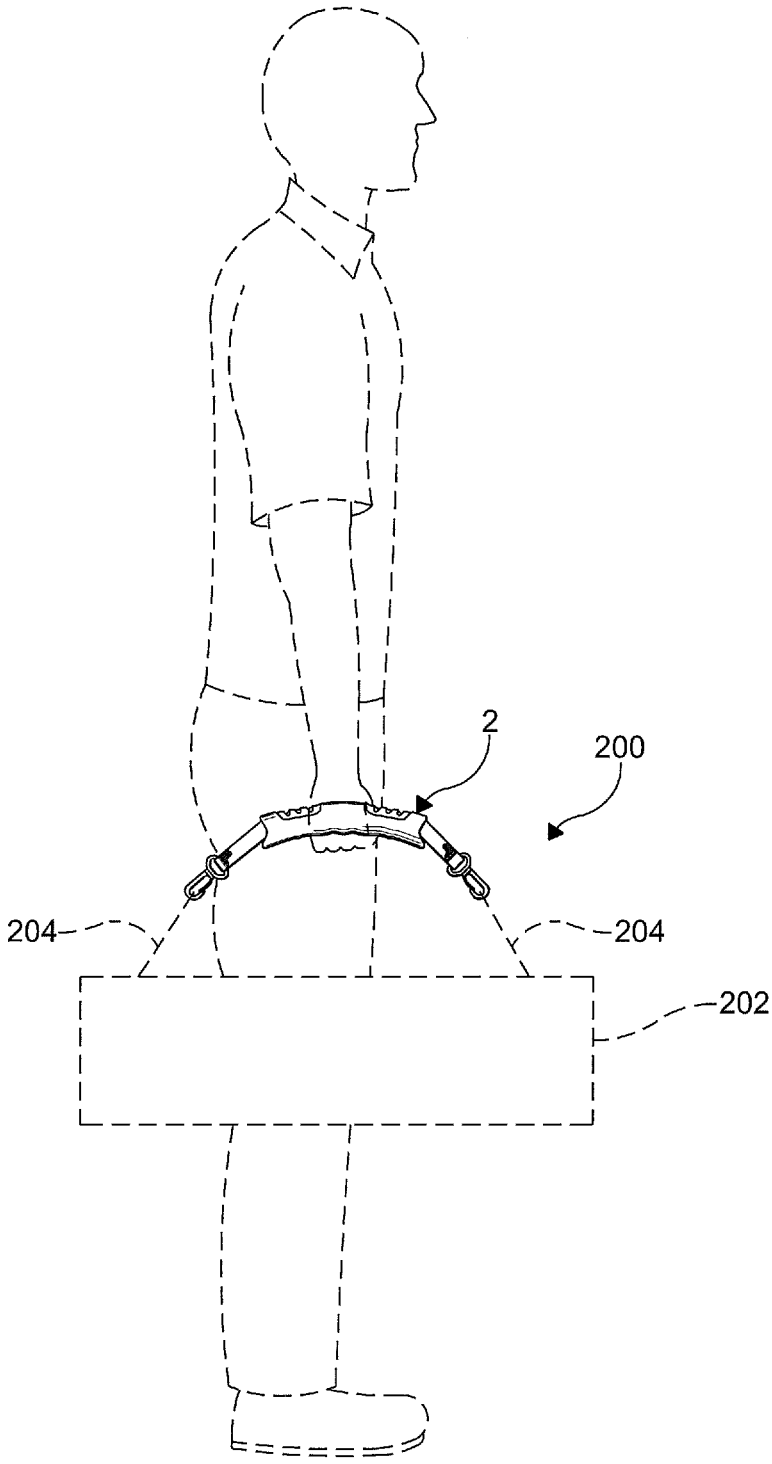
FIG. 4 is a side elevational view of a load or package carried by a user with the detachable handle shown in FIG. 1.
Figure 5:
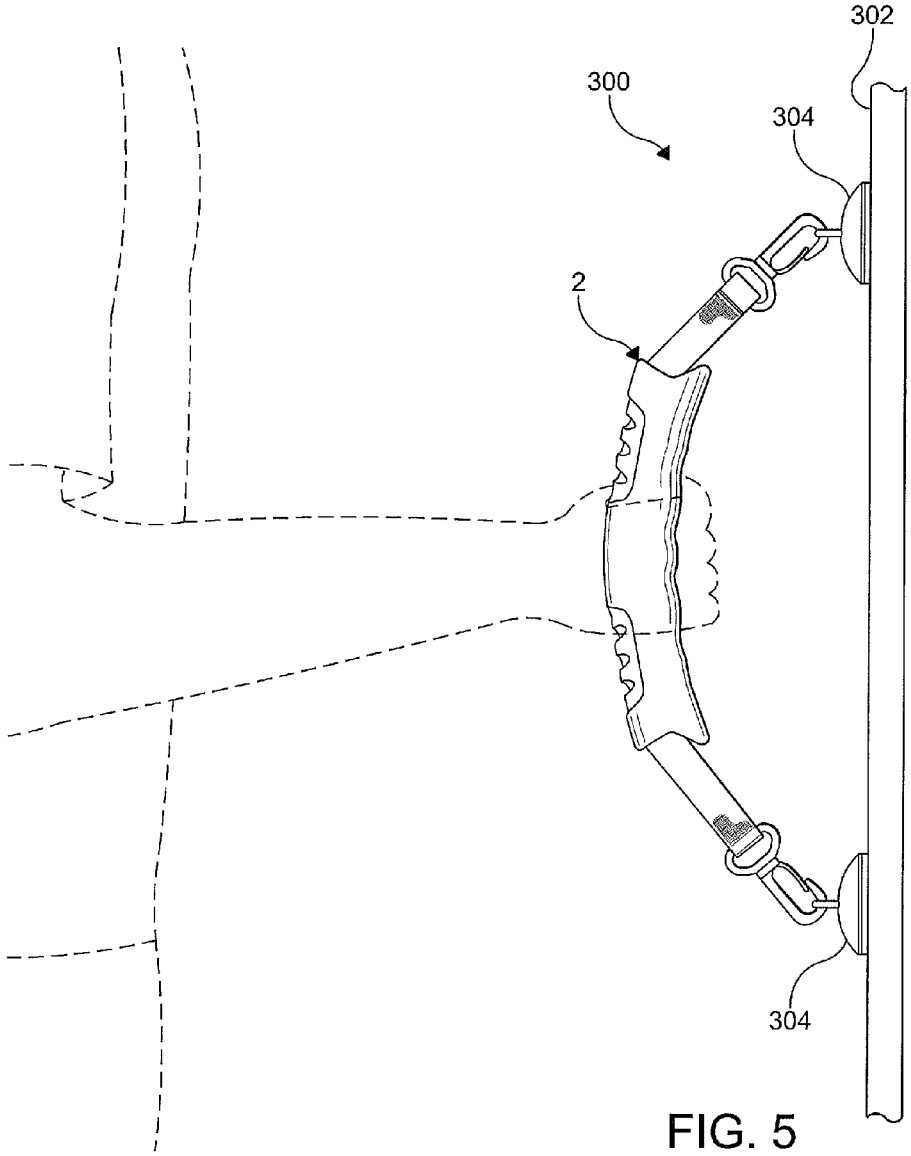
FIG. 5 is an enlarged side elevational view of the detachable handle shown in FIG. 1 removably attached to a surface, further showing the detachable handle cooperating with suction cups for removably affixing the detachable handle to the surface.

As shown in FIGS. 1-5, the present disclosure includes a detachable handle 2. The detachable handle 2 is particularly useful as a grip for a personal floatation device 100, as shown in FIG. 3. The detachable handle 2 may also be used to carry one of a load and a package, for example, as illustrated in FIG. 4. It should also be understood that the detachable handle 2 may be removably affixed to a wall of a large body structure, as illustrated in FIG. 5. As nonlimiting examples, the detachable handle 2 may be removably affixed to the wall of a vehicle such as a boat (e.g., to provide a handle to hold while washing the vehicle), or the wall of a room in a building (e.g., to provide a nurse with a handle to hold while helping patients in a shower or bath). One of ordinary skill in the art understands that other suitable uses for the detachable handle 2 are also within the scope of the present disclosure.

Figure 1:
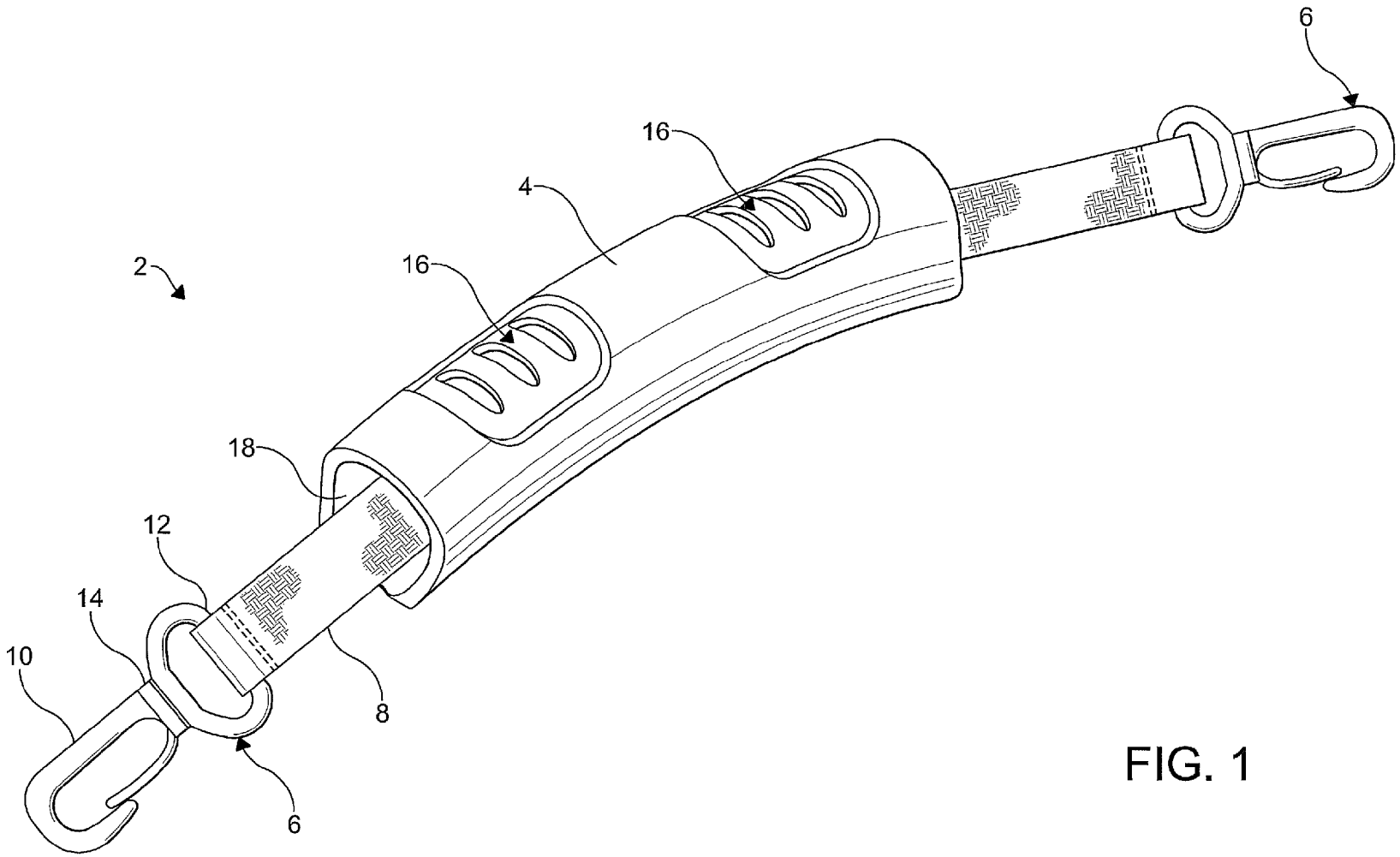
FIG. 1 is a front perspective view of a detachable handle according to one embodiment of the present disclosure.

Referring to FIG. 1, the detachable handle 2 includes a tubular grip 4 and a pair of swivel clips 6. A flexible elongate member 8 is disposed through the tubular grip 4. Each of the swivel clips 6 is coupled to the flexible elongate member 8. The swivel clips 6 are disposed at opposite ends of the tubular grip 4. Advantageously, the swivel clips 6 militate against a removal of the flexible elongate member 8 from the tubular grip 4 when the detachable handle 2 is being used.

The tubular grip 4 is formed from a durable material that facilitates a secure gripping of the detachable handle 2 by a user. In certain embodiments, the tubular grip 4 is molded from one of plastic and rubber. For example, a foam rubber may be employed in a molding process to form the tubular grip 4. In one embodiment, the tubular grip is about 4.5" long and about 3" in diameter. Other suitable materials and sizes for the tubular grip 4 may also be used within the scope of the disclosure.

In particular embodiments, the flexible elongate member 8 is a closed loop of a durable material. For example, the durable material may be in the form of a webbing. As another example, the durable material may be in the form of a rope or cord. Woven or non-woven fabrics may also be employed. The durable material can support the weight of a typical person without breaking, and can desirably withstand exposure to outdoors environments, including exposure to water or moisture. Nonlimiting examples of the durable material are polypropylene and nylon. In one embodiment, the full length of the flexible elongate member 8, not in a closed loop, is about 13.5", and the width of the flexible elongate member 8 is about 0.625". A skilled artisan may select other suitable materials and sizes for the flexible elongate member 8, as desired.

As depicted in FIG. 1, each of the swivel clips 6 has a clip portion 10, an attachment portion 12, and a swivel portion 14. The clip portion 10 permits a removable attachment of the detachable handle 2 to a desired object or surface. The attachment portion 12 couples the swivel clip 6 to the flexible elongate member 8. For example, the attachment portion 12 may be a ring through which the flexible elongate member 8 is disposed. The swivel portion 14 is rotatably connected to the attachment portion 12, and permits a 360 degree rotation of the clip portion 10. The swivel clip 6 is formed from a durable material such as metal or polymer. In one embodiment, the swivel clip 6 is about 2" in length and about 0.75" in width, and can support at least 20 kilograms of weight. Other configurations, materials, and sizes for the swivel clips may also be used within the scope of the instant disclosure.

In certain embodiments, the attachment portion 12 of the swivel clip 6 is larger than an adjacent aperture 18 of the tubular grip 4. Since the attachment portion 12 on each of the swivel clips 6 at opposite ends of the tubular grip has the larger size than the adjacent apertures 18, it should be appreciated that the attachment portions 12 militates against a removal of the flexible elongate member 8 from the tubular grip 4. This is particularly advantageous, as separate structure for holding the flexible elongate member 8 within the tubular grip 4 is not necessary.

The tubular grip 4 of the present disclosure may have at least one gripping feature 16 formed in an outer surface of the tubular grip 4. For example, the at least one gripping feature 16 may include grooves formed in the outer surface of the tubular grip 4. The grooves may be oriented substantially transverse to an axis along which the tubular grip 4 is oriented. The grooves may be formed through the tubular grip 4 in order to provide vents through which air and water may escape from an inside of the tubular grip 4. Other types of vent holes may also be formed in the tubular grip 4 for this purpose.

In other embodiments, the at least one gripping feature 16 may include a texturing of the outer surface of the tubular grip 4, in order to facilitate the gripping of the detachable handle 2 by the user. The texturing may include the formation of bumps or nodules on the outer surface, for example.

As shown in FIG. 1, the tubular grip 4 may also have a curvature along a length of the tubular grip 4 that facilitates a secure grabbing of the tubular grip 4 by the user. An underside of the tubular grip 4 may further have indentations, as shown in FIGS. 2B-2D, for placement of the fingers of the user. Other suitable types gripping features 16 and configurations may also be used, as desired.

With reference to FIGS. 3-5, the detachable handle 2 may be provided in a detachable handle system 100, 200, 300. As shown in FIG. 3, the detachable handle 2 may be used with a personal floatation device 102 such as a life jacket. The personal floatation device 102 may have a strap or a web loop 104 to which the swivel clips 6 of the detachable handle 2 removably attach.

As shown in FIG. 4, the detachable handle 2 may be used with one of a load and a package 202, and permit the user to carry the one of the load and the package 202. The swivel clips 6 may removably attach, for example, to straps 204 that are either connected to, or wrapped around, the one of the load and the package 202. Other means for removably attaching the one of the load and the package 202 to the swivel clips 6 of the detachable handle 2 may also be used, as desired.

In one embodiment shown in FIG. 5, the detachable handle system 300 may include a pair of suction cups 304. The suction cups 304 may have rings on an outer surface to which the swivel clips 6 of the detachable handle 2 removably attach. Each ring may be attached to, or formed integrally with, a main body of the suction cup 304. The suction cups 304 permit the attachment of the detachable handle 2 to a surface of a structure 302 that does not have straps, loops, or other attachment means. Advantageously, the suction cups 304 permit the removable attachment of the detachable handle 2 to a wall of a large body object such as a vehicle or a building.

With renewed reference to FIGS. 2A-2D, the present disclosure includes a method for manufacturing the detachable handle 2. The flexible elongate member 8 is provided, and has a pair of free ends 20. One of a pair of the swivel clips 6 is disposed on the flexible elongate member 8, for example, by threading one of the free ends 20 through the attachment portion 12 of the swivel clip 6.

Both free ends 20 of the flexible elongate member 8 are then disposed through the tubular grip 4, for example, as shown in FIG. 2B. Another of the pair of swivel clips 6 is disposed over one of the free ends 20 of the flexible elongate member 8. The swivel clips 6 are thereby disposed on opposite ends of the tubular grip 4.

The free ends 20 are then connected to form a closed loop. For example, the step of connecting the pair of free ends 20 to form the closed loop may include a melting together of the free ends 20 to form a sealed portion 22, as shown in FIG. 2D. The sealed portion 22 that completes the closed loop may alternatively be formed by other means including mechanical fasteners, adhesives, and the like.

The swivel clips 6 may be further secured at opposite ends of the closed loop by stitching the flexible elongate member 8 adjacent the swivel clips 6. Stitches 24 may be disposed adjacent the attachment portion 12 on each of the swivel clips 6, for example. It should be understood that, before stitching the flexible elongate member 8, the flexible elongate member 8 may be adjusted as shown in FIG. 1 so that the sealed portion 22 is disposed inside of the tubular grip 4 and is not exposed. Other means for securing the swivel clips 6 at the opposite ends of the closed loop may also be used, as desired.

Advantageously, the detachable handle 2 of the present disclosure is highly adaptable for a variety of uses, and may be used with a conventional personal floatation device, as well as for other uses such as the carrying of a load or package.

While certain representative embodiments and details have been shown for purposes of illustrating the invention, it will be apparent to those skilled in the art that various changes may be made without departing from the scope of the disclosure, which is further described in the following appended claims.

What is claimed is:

1. A detachable handle, comprising:

a hollow tubular grip having a first aperture disposed at a first end of the tubular grip and a second aperture disposed at a second end of the tubular grip, the first end disposed opposite the second end, and at least one gripping feature formed in an outer surface of the tubular grip, wherein the at least one gripping feature includes a plurality of vent holes formed through the tubular grip;

a flexible elongate member formed from a closed loop of durable material, the closed loop of durable material having a first half portion and an adjacent second half portion, each of the first half portion and the second half portion of the closed loop of durable material disposed through both the first aperture and the second aperture of the tubular grip; and a pair of swivel clips including a first swivel clip and a second swivel clip, the first swivel clip coupled to the flexible elongate member and disposed adjacent the first end of the tubular grip, the second swivel clip coupled to the flexible elongate member and disposed adjacent the second end of the tubular grip, the swivel clips together militating against removal of the flexible elongate member from the tubular grip, wherein the flexible elongate member extends along an inner surface of the tubular grip with no intervening material disposed therebetween, the inner surface of the tubular grip defining the first aperture and the second aperture, the tubular grip thereby permitted freedom of movement to slide along the flexible elongate member between the first swivel clip and the second swivel clip, and to also move in a direction transverse and relative to the flexible elongate member, and wherein the at least one gripping feature includes a plurality of indentations formed on an underside of the tubular grip and a plurality of recesses formed on a topside of the tubular grip, wherein the indentations are configured to receive fingers of a user, and each of the recesses have opposing edges that are both oriented substantially transverse to the elongate member, and the vent holes include grooves formed in each of the recesses, the grooves oriented substantially transverse to an axis along which the tubular grip is oriented.

2. The detachable handle of claim 1, wherein the durable material is a webbing.

3. The detachable handle of claim 2, wherein the webbing is formed from one of polypropylene and nylon.

4. The detachable handle of claim 1, wherein the tubular grip is formed from one of plastic and rubber.

5. The detachable handle of claim 1, wherein each of the swivel clips includes a clip portion, a swivel portion, and an attachment portion.

6. The detachable handle of claim 5, wherein the attachment portion is coupled to the flexible elongate member and is larger than an adjacent one of the first aperture and the second aperture of the tubular grip for militating against the removal of the flexible elongate member from the tubular grip.

7. The detachable handle of claim 1, further comprising a pair of suction cups, each of the suction cups removably coupled to one of the swivel clips.

8. The detachable handle of claim 1, wherein the tubular grip has a curvature along a length of the tubular grip that facilitates a grabbing of the tubular grip.

9. The detachable handle of claim 1, wherein each of the swivel clips can support at least 30 kilograms of weight.

10. A method for manufacturing a detachable handle, the method comprising the steps of:

providing a flexible elongate member of a durable material having a first half portion and an adjacent second half portion, the first half portion having a first free end and the second half portion having a second free end;

disposing one of a pair of swivel clips on the flexible elongate member, the pair of swivel clips including a first swivel clip and a second swivel clip;

providing a hollow tubular grip having a first aperture disposed at a first end of the tubular grip and a second aperture disposed at a second end of the tubular grip, the first end disposed opposite the second end, and at least one gripping feature formed in an outer surface of the tubular grip, wherein the at least one gripping feature includes a plurality of vent holes formed through the tubular grip;

disposing the first and second free ends of the flexible elongate member through the tubular grip;

disposing another of the pair of swivel clips over one of the first and second free ends of the flexible elongate member, the swivel clips disposed on opposite ends of the tubular grip; and connecting the first and second free ends to form a closed loop, the swivel clips militating against a removal of the flexible elongate member from the tubular grip, wherein the flexible elongate member extends along an inner surface of the tubular grip with no intervening material disposed therebetween, the inner surface of the tubular grip defining the first aperture and the second aperture, the tubular grip thereby permitted freedom of movement to slide along the flexible elongate member between the first swivel clip and the second swivel clip, and to also move in a direction transverse and relative to the flexible elongate member, and wherein the at least one gripping feature includes a plurality of indentations formed on an underside of the tubular grip and a plurality of recesses formed on a topside of the tubular grip, wherein the indentations are configured to receive fingers of a user, and each of the recesses have opposing edges that are both oriented substantially transverse to the elongate member, and the vent holes include grooves formed in each of the recesses, the grooves oriented substantially transverse to an axis along which the tubular grip is oriented.

11. The method of claim 10, wherein the step of connecting the first and second free ends to form a closed loop includes a melting together of the first and second free ends.

12. The method of claim 11, further including a step of stitching the flexible elongate member adjacent the swivel clips to secure the swivel clips at opposite ends of the closed loop.

13. A detachable handle system, comprising:

a surface; and a detachable handle removably coupled to the surface, the detachable handle including a hollow tubular grip having a first aperture disposed at a first end of the tubular grip and a second aperture disposed at a second end of the tubular grip, the first end disposed opposite the second end, and at least one gripping feature formed in an outer surface of the tubular grip, wherein the at least one gripping feature includes a plurality of vent holes formed through the tubular grip, a flexible elongate member formed from a closed loop of durable material, the closed loop of durable material having a first half portion and an adjacent second half portion, each of the first half portion and the second half portion of the closed loop of durable material disposed through both the first aperture and the second aperture of the tubular grip, and a pair of swivel clips including a first swivel clip and a second swivel clip, the first swivel clip coupled to the flexible elongate member and disposed adjacent the first end of the tubular grip, the second swivel clip coupled to the flexible elongate member and disposed adjacent the second end of the tubular grip, the swivel clips together militating against removal of the flexible elongate member from the tubular grip, wherein the flexible elongate member extends along an inner surface of the tubular grip with no intervening material disposed therebetween, the inner surface of the tubular grip defining the first aperture and the second aperture, the tubular grip thereby permitted freedom of movement to slide along the flexible elongate member between the first swivel clip and the second swivel clip, and to also move in a direction transverse and relative to the flexible elongate member, and wherein the at least one gripping feature includes a plurality of indentations formed on an underside of the tubular grip and a plurality of recesses formed on a topside of the tubular grip, wherein the indentations are configured to receive fingers of a user, and each of the recesses have opposing edges that are both oriented substantially transverse to the elongate member, and the vent holes include grooves formed in each of the recesses, the grooves oriented substantially transverse to an axis along which the tubular grip is oriented.

14. The system of claim 13, wherein the surface is provided by one of a personal floatation device, a load, a package, and a wall.

15. The system of claim 14, wherein the personal floatation device is a life jacket.

16. The system of claim 15, wherein the swivel clips are removably attached to one of a strap and a web loop of the life jacket.

17. The system of claim 13, further comprising a pair of suction cups, each of the suction cups removably coupled to one of the swivel clips and removably affixed to the surface.

* * * * *